United States Patent [19]

Miller

[11] Patent Number: 4,905,641

[45] Date of Patent: Mar. 6, 1990

[54] COLD-START ENGINE PRIMING AND AIR PURGING SYSTEM

[75] Inventor: James K. Miller, Cass City, Mich.

[73] Assignee: Walbro Corporation, Cass City, Mich.

[21] Appl. No.: 324,035

[22] Filed: Mar. 16, 1989

Related U.S. Application Data

[62] Division of Ser. No. 118,629, Nov. 9, 1987, Pat. No. 4,848,290.

[51] Int. Cl.[4] ..... F02M 1/16

[52] U.S. Cl. ..... 123/187.5 R; 123/180 E; 123/180 P; 123/180 T; 123/516

[58] Field of Search ..... 123/187.5 R, 180 E, 123/180 P, 180 T, 516; 261/DIG. 8

[56] References Cited

U.S. PATENT DOCUMENTS 4,694,792 9/1987 Uuskallio ..... 123/187.5 R

FOREIGN PATENT DOCUMENTS 55-164747 12/1980 Japan ..... 123/187.5 R

*Primary Examiner*—Andrew M. Dolinar

*Attorney, Agent, or Firm*—Barnes, Kisselle, Raisch, Choate, Whittemore & Hulbert

[57] ABSTRACT

A fuel delivery system for purging air from the reservoir of a diaphragm carburetor on an internal combustion engine and for supplying priming fuel to the carburetor air intake. A pump is responsive to electrical signals from priming control circuitry to draw fuel through the carburetor reservoir and to fuel under pressure to a nozzle positioned at the carburetor air intake. The electronic control circuitry is responsive to an operator for initiating a priming operation and includes a temperature sensor coupled to the engine for controlling duration of the priming operation, and thus the quantity of engine priming fuel, as a function of engine temperature. A second timer is responsive to operator initiation of a priming operation for preventing regeneration of the priming control signal to the pump, and thereby preventing attempting repriming in the event of failure of the engine to start.

16 Claims, 4 Drawing Sheets

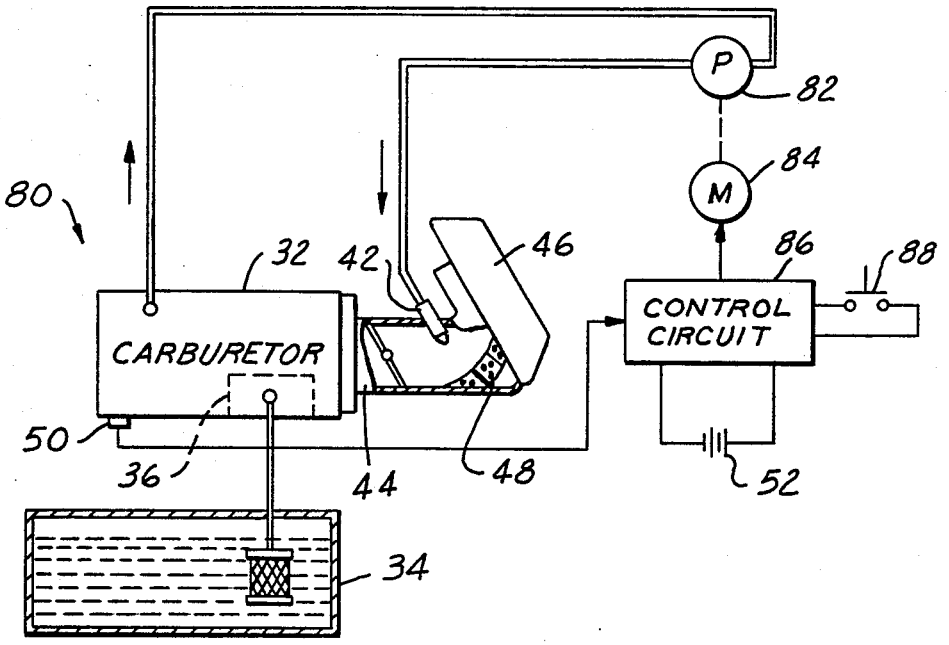
FIG.4
FIG.5
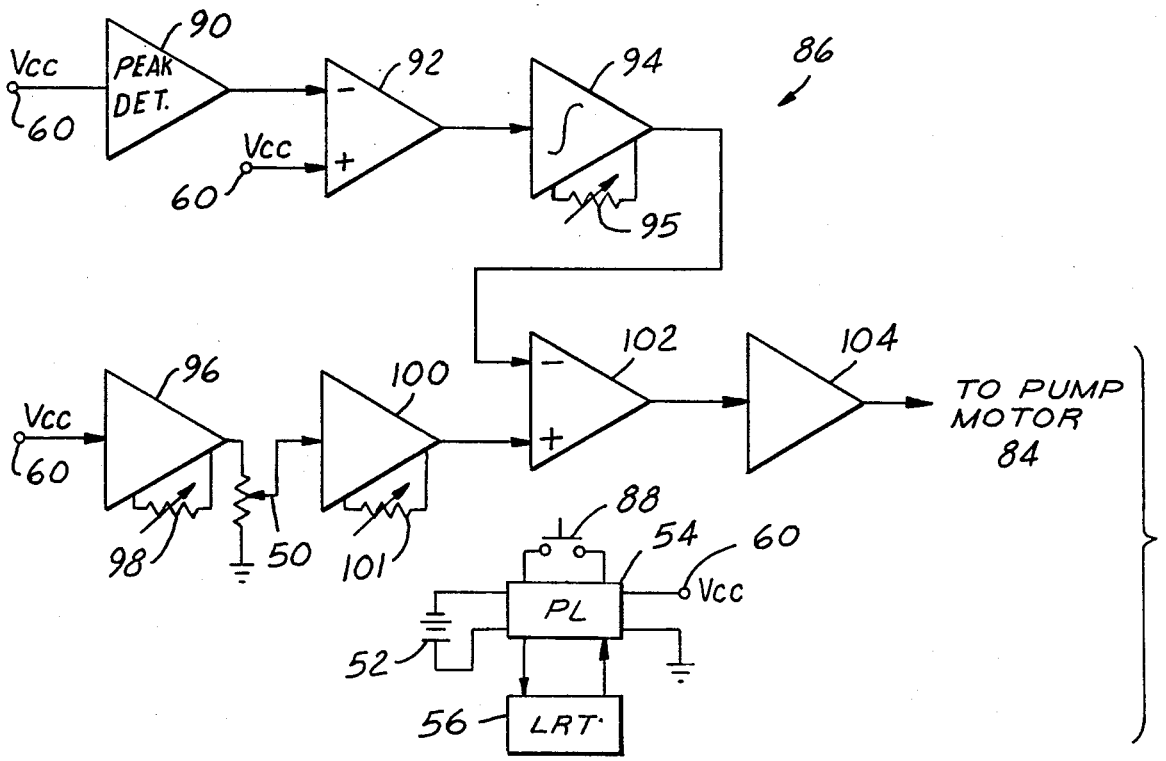

POWER LATCH
LRT
VCC
SWITCHING VOLTAGE REGULATOR (MC33063)
TO PUMP MOTOR 84
VOLTAGE REGULATOR
88
54
60
52
56
86a
111
112
117
92
94
114
118
96
50
102
120
122

COLD-START ENGINE PRIMING AND AIR PURGING SYSTEM

This application is a division of copending application, Ser. No. 118,629, filed Nov. 9, 1987, now U.S. Pat. No. 4,848,290.

The present invention is directed to fuel delivery systems for internal combustion engines, and more particularly to a system for priming and purging air from an engine fuel delivery system to facilitate cold starting thereof.

BACKGROUND AND OBJECTS OF THE INVENTION

Cold starting of internal combustion engines, particularly small engines in chainsaws, snow blowers and the like, has been and remains a problem in the art. Devices such as chainsaws which are frequently employed under adverse starting conditions typically embody a manual priming system, as illustrated in U.S. Pat. No. 4,271,093 (June 2, 1981), in which a resilient cap or bulb is mounted on or adjacent to the engine carburetor and may be manually activated by an operator for drawing fuel into the carburetor and purging air therefrom. Excessive activation of the cap or bulb when the engine is cold typically results in ejection of fuel into the surrounding environment. Moreover, activation of the priming system when the engine is warm, or where the engine fails to start on the first attempt, can so flood the engine carburetor that the engine will not start at all.

It is therefore a general object of the present invention to provide a system for priming and purging air from the fuel lines and reservoir of an internal combustion engine so as to facilitate cold starting thereof and which overcomes the deficiencies set forth above. More specifically, it is an object of the present invention to provide a system of the described character which will facilitate one-pull starting of the engine over an extended engine temperature range of −40° F. to +150° F., which is so constructed as to prevent misuse by an inexperienced operator, including particularly over priming of the engine, which is powered by replaceable batteries, which is inexpensive in assembly and reliable over an extended operating lifetime, and which requires minimum adaptation to particular engine designs and requirements.

SUMMARY OF THE INVENTION

An engine priming and air purging system in accordance with the present invention includes a pump mechanism coupled to a fuel supply and responsive to an electrical priming control signal for selectively supplying fuel under pressure. The pump mechanism is coupled to a nozzle or other suitable device positioned at the air intake of the engine carburetor for feeding or spraying fuel under pressure from the pump mechanism into the air intake. Pump control electronics includes structure directly or indirectly responsive to an operator for initiating a priming operation and delivering priming control signals to the pump mechanism for a controlled time duration. In the preferred embodiments of the invention, the engine carburetor comprises a diaphragm-type carburetor having an internal fuel reservoir as illustrated in the above-identified U.S. Pat. No. 4,271,093. The pump mechanism is coupled to the fuel supply through the carburetor reservoir so that activation of the pump mechanism automatically fills the reservoir while purging trapped air therefrom.

In accordance with one important aspect or feature of the present invention, a temperature sensor is positioned so as to be responsive to engine temperature, and the priming control signal has a time duration which varies as a function of engine temperature. In this way, the amount of priming fuel delivered to the carburetor air intake is a direct (inverse) function of engine temperature, with a greater quantity of priming fuel being delivered when the engine is cold, a lesser amount when the engine is warm, and no priming fuel at all being delivered when the engine is hot. Further, in accordance with another important aspect of the invention, the priming control electronics includes facility for preventing regeneration of the priming control signal to the pump mechanism for a preselected extended time duration on the order of several minutes or more independently of the operator. In this way, repriming, flooding and/or fuel spill is prevented in the event of failure to start on first pull.

In one semi-automatic embodiment of the invention, the pump mechanism comprises a manual suction pump including an expansible internal volume for drawing and holding a predetermined volume of fuel under pressure. The pump output is normally coupled through a solenoid valve and through a restriction to a return line to the fuel supply. In response to priming control signals from the control electronics, the solenoid valve couples the pump output to the carburetor air intake. The pump includes a switch responsive to manual filling of the pump chamber for automatically initiating the priming operation. Thus, fuel is delivered to the carburetor air intake by the pump through the solenoid valve for a priming time duration determined by the control electronics, and excess fuel is returned to the fuel supply along with air purged from the carburetor and fuel lines.

In a fully-automatic second embodiment of the invention, the pump mechanism comprises a motor-driven pump coupled to the fuel supply through the carburetor reservoir. Pump motor load is monitored by the control electronics for distinguishing between time intervals in which purged air is delivered to the carburetor intake, characterized by a relatively low load on the pump, and time intervals in which fuel is delivered to the carburetor intake when the pump motor draws more current from the battery power supply. The latter time intervals are integrated or summed in the control electronics while the air-purge intervals are ignored, so that the total time duration of pump operation accurately reflects quantity of priming fuel actually delivered to the carburetor intake. The control electronics is activated by a separate operator switch and may include a battery voltage monitor for compensating the priming-duration electronics for decrease in battery power.

BRIEF DESCRIPTION OF THE DRAWINGS

The invention, together with additional objects, feature and advantages thereof, will be best understood from the following description, the appended claims and the accompanying drawings in which:

FIG. 4 is a schematic diagram of a fully automatic priming system in accordance with a second embodiment of the invention;

FIG. 5 is a functional block diagram of priming control electronics in the system of FIG. 4;

DETAILED DESCRIPTION OF PREFERRED EMBODIMENTS

Figure 1:
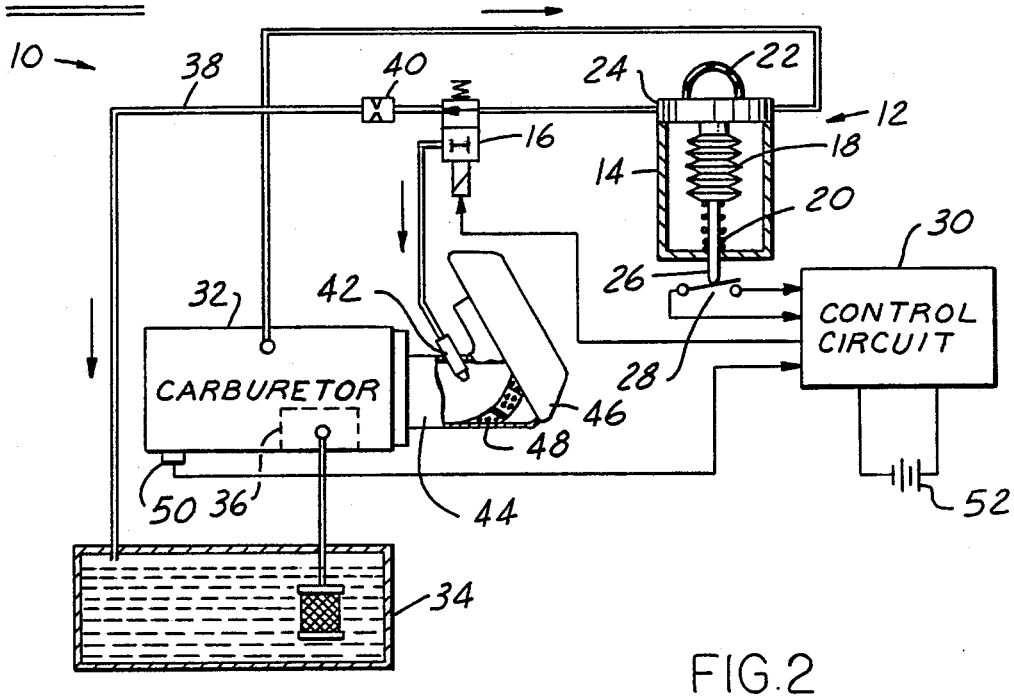
FIG. 1 is a schematic diagram of a fuel priming system in accordance with a semi-automatic embodiment of the invention.

FIG. 1 illustrates a semi-automatic fuel priming system 10 in accordance with one embodiment of the invention as comprising a pump mechanism 12 including a manual bellows-type suction pump 14 and a solenoid valve 16. Pump 14 contains bellows 18 for accepting and containing a predetermined volume of fuel under pressure exerted by the coil spring 20. A resilient dome or bulb 22 cooperates with a check valve assembly 24 for selectively drawing fuel through the pump intake into bellows 18, and for supplying fuel to the pump output under pressure from spring 20. A pin 26 extends from bellows 18 through spring 20 and through the housing of pump 14 to engage a switch 28 for indicating to the priming control electronics 30 that the pump reservoir is full. The inlet of pump 14 is connected through a carburetor 32 to a fuel supply 34. Carburetor 32 is preferably of the diaphragm type and includes an internal metering chamber or reservoir 36 from which fuel is normally pumped under control of pressure pulses from the engine crankcase. Such carburetors per se are of conventional construction, and an exemplary diaphragm-type carburetor of the described character is illustrated in U.S. Pat. No. 4,271,093.

The output of pump 14 is fed through a normally-open port in solenoid valve 16 to a line 38 for return to fuel supply 34. A restriction or orifice 40 is positioned in line 38 for retarding such fuel return. The normally-closed port of valve 16 is connected to a nozzle 42 positioned at the air intake 44 of carburetor 32 between the carburetor and the air filter 46. A contoured block 48 of foam or other suitable construction is positioned within intake 44 across from and in opposition to nozzle 42 for receiving and absorbing fuel droplets sprayed therefrom, and for re-evaporating fuel into air passing thereby into carburetor 32. A temperature sensor 50 is positioned on the engine at any suitable location so as to be responsive to temperature thereof. Sensor 50, as well as the coil of solenoid valve 16, are connected to control circuit 30, as is the battery 52 for supplying electrical power thereto.

Figure 2:
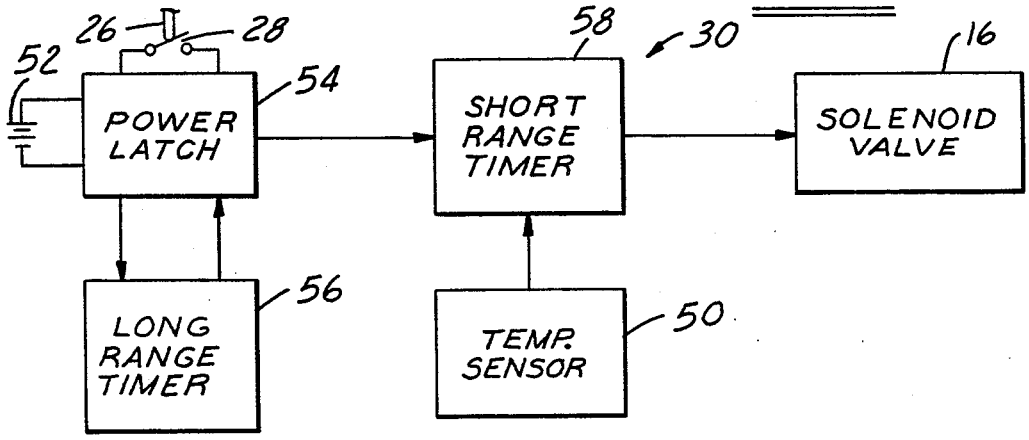
FIG. 2 is a functional block diagram of the priming control electronics in FIG. 1.

Control electronics 30 is illustrated in FIG. 2 as comprising a power latch 54 for receiving power from battery 52 and conveying such power to the remainder of the electronics under control of the pump-responsive switch 28 and a long range timer 56. The output of latch 54 is coupled to a short range timer 58 which receives a control input from temperature sensor 50 and provides a priming control output to solenoid valve 16. In general, a priming operation is initiated through manual activation of pump 14 by an operator. As air is drawn into pump 14, it is automatically and continuously purged through valve 16 and restrictor 40. When the internal pump reservoir is full of fuel, pin 26 engages and closes switch 28, and battery power is applied by latch 54 to short range timer 58. Timer 58 then energizes solenoid valve 16 for a time duration which depends upon engine temperature as indicated by sensor 50. Thus, solenoid valve 16 is energized and feeds fuel under pressure from pump 14 to nozzle 42 for a time duration which varies as a direct function, specifically an inverse function, of engine temperature. In the meantime, latch 54 also supplies power to long range timer 56. Upon termination of the priming control signal from short range timer 58, long range timer 56 cooperates with latch 54 to inhibit or prevent reactivation of short range timer 58 for an extended time duration. Any excess fuel in pump 14—i.e., fuel not required for engine priming—is slowly returned to fuel supply 34 through restriction 40 and return line 38 following termination of the priming operation. Restriction 40 may be on the order of 0.001 inch, for example. The capacity of pump 14 would typically be at least 1.5 cc to 2 cc greater than maximum quantity of fuel required for priming, and spring 20 is preferably constructed to provide linear flow output over the expected volumetric range. Long range timer 56 has a fixed duration which may be on the order of five minutes.

Figure 3:
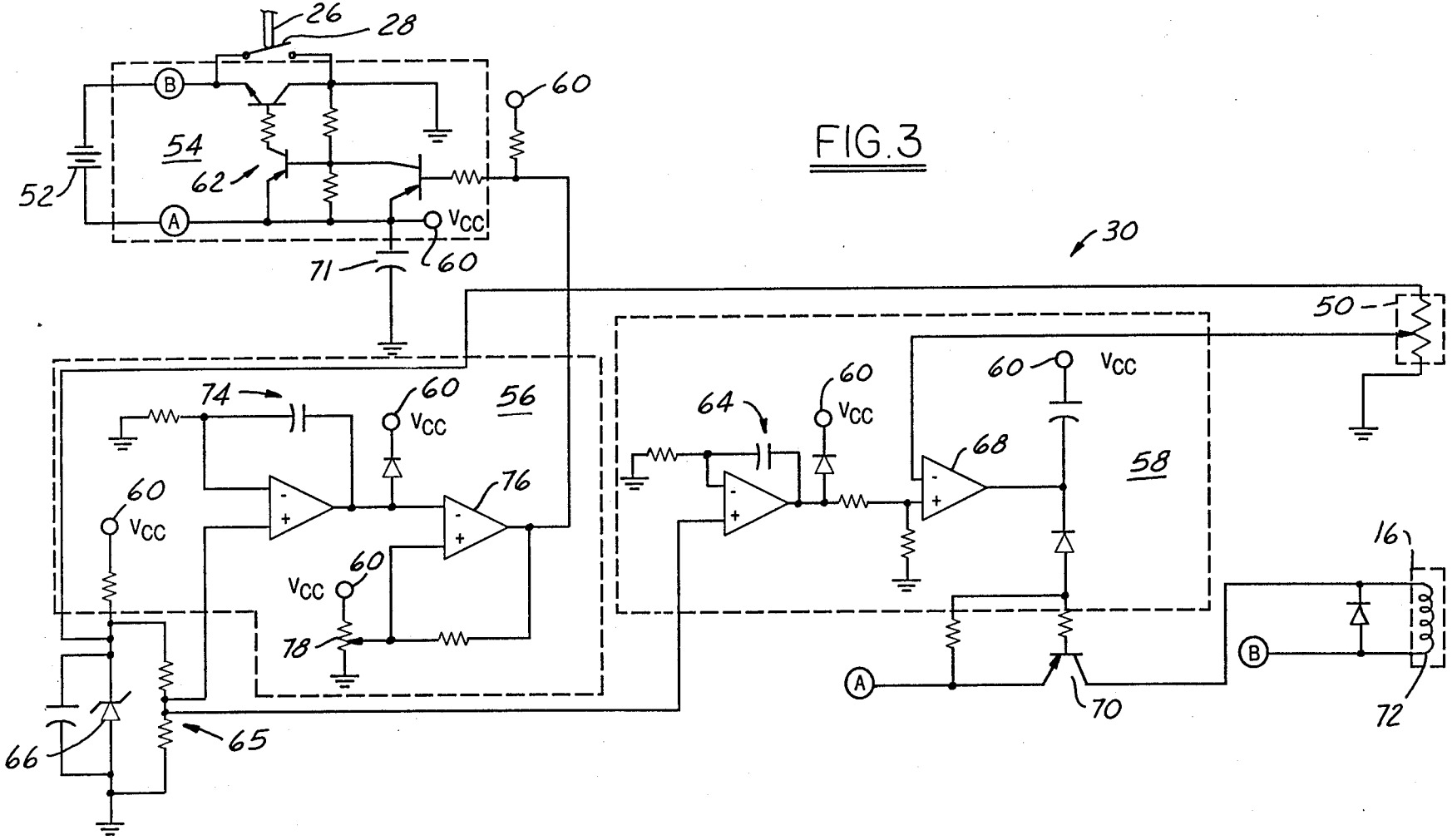
FIG. 3 is an electrical schematic diagram of the priming control electronics in the embodiment of FIGS. 1 and 2.

FIG. 3 illustrates priming control electronics 30 in greater detail. Battery 52 supplies power within latch 54 to a Vcc bus 60 under control of a transistor switch 62 which is activated by momentary depression of pump switch 28. An integrator 64 within timer 58 receives a reference input from the voltage divider 65 which is connected across a zener diode 66 between bus 60 and ground. Integrator 64 thus supplies a ramp signal of increasing voltage to the non-inverting input of a comparator 68. The inverting input of comparator 68 is connected to temperature sensor 50, which itself takes the form in the preferred embodiments of the invention of a variable resistor-type voltage divider connected in parallel with divider 65 across diode 66. The output of comparator 68 is connected through a drive transistor 70 to the coil 72 of solenoid valve 16. Note that drive transistor 70 and coil 72 are connected directly across battery power through terminals A and B, while the remainder of the control electronics is powered by bus 60 through latch 54. Timer 56 includes a second integrator 74 connected to divider 65 to supply an output voltage ramp signal to the inverting input of a comparator 76. The non-inverting input of comparator 76 is connected to a variable resistor 78 which is factory adjusted for determining the time constant of long range timer 56. The output of comparator 76 is connected to a reset input of latch 54.

In operation, latch 54 is initially activated by closure of switch 28 which connects the battery to ground and thereby applies power from battery 52 to bus 60. Bus power closes transistor switch 62 to connect the battery to ground independently of switch 28, which will reopen as fuel is pumped to nozzle 42 (FIG. 1) from within the pump reservoir. Both integrator 64 within timer 58 and integrator 74 within timer 56 begin integrating upon application of power to bus 60 so as to provide increasing voltage ramp signals at their respective outputs. At the same time, coil 72 of solenoid valve 16 is energized by transistor 70, the output of comparator 68 being low, to begin feeding fuel under pressure from pump 14 to nozzle 42 (FIG. 1). When the output of integrator 64 reaches the level of the reference input to comparator 68 from temperature sensor 50, comparator 68 turns off transistor 70, which de-energizes solenoid valve 16 and terminates the priming operation.

In the meantime, integrator 74 within timer 56 continues to integrate, transistor switch 62 remains switched by a high input from comparator 76, and power continues to be applied to bus 60 independently of switch 28. As long as power is so applied to bus 60, integrator 64 cannot discharge, the output of integrator 64 remains above the temperature-reference level at comparator 68, and priming cannot be reinitiated even if switch 28 is reclosed. Thus, even if the engine fails to start on first pull and the operator attempts to reprime by activating pump 14 (FIG. 1), refilling pump bellow 18 ad reclosing switch 28, such switch closure will not energize solenoid valve 16. Rather, the fuel within the pump reservoir will gradually return to the fuel supply through line 38 and restrictor 40. Thus, provision of return 38 and restrictor 40 not only provides an air purge path from pump 14, but also ensures that the pump will empty in the event that the operator attempts to prime when priming should not take place.

When the output of integrator 74 reaches the long-range reference level determined by resistor 78, a low output from comparator 76 deactivates transistor switch 62, disconnecting the negative terminal battery 52 from ground and thereby removing power from bus 60. Capacitor 71 across bus 60 stores sufficient energy to drive transistor switch 62 fully open. Integrators 64, 74 rapidly discharge, and a priming operation can then be reinitiated through closure of switch 28. It will be appreciated that connection of battery 52 to bus 60 through transistor switch 62 as hereinabove described prevents consumption of battery power during extended periods in which the priming system remains unused, and thereby substantially extends battery operating lifetime. If the operator attempts to prime a hot engine, the temperature reference input to comparator 68 from sensor 50 will be sufficiently low that comparator 68 turns off transistor 70 as soon as power is applied to bus 60. Again, the fuel within pump 14 (FIG. 1) will gradually return to the supply.

FIG. 4 illustrates a fully automatic priming system 80 in accordance with another embodiment of the invention in which the pump mechanism comprises a pump 82 driven by a d.c. motor 84 under control of priming control electronics 86. Pump 82 is connected directly to nozzle 42. Pump control electronics 86 receives an input from an operator pushbutton 88 for initiating a priming operation. Remaining elements in the system 80 of FIG. 4 are identical to those hereinabove described in detail in connection with FIGS. 1-3, and are indicated by corresponding reference numerals. FIG. 5 is a fragmentary functional block diagram of one embodiment of control electronics 86. Latch 54 and long range timer 56 are identical to those elements hereinabove described in detail in connection with FIGS. 2 and 3. The Vcc power bus 60 is connected through a peak detector 90 to a comparator 92 which receives a reference input from bus 60. The output of comparator 92 is fed to an integrator 94. The slope of integrator 94 is factory adjusted by means of the resistor 95. Bus 60 is also connected through a battery compensation amplifier 96 having a resistor 98 for factory-adjustment of compensation slope. The output of battery compensator 96 is fed to sensor 50. A temperature compensation amplifier 100 receives an input from temperature sensor 50 and has a factory-adjusted slope set by resistor 101. The output of temperature compensator 100 is supplied as a reference input to a comparator 102 which receives a signal input from integrator 94. The output of comparator 102 is connected through a drive amplifier 104 to pump motor 84.

Figure 7:
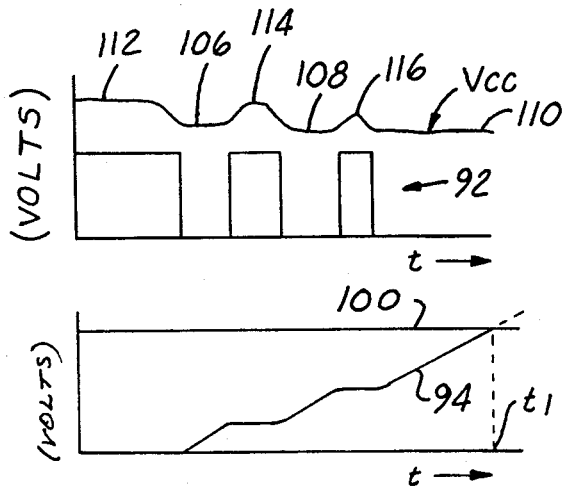
FIG. 7 is a graphic illustration useful in describing operation of the priming control embodiments of FIGS. 5 and 6.

In operation of control electronics 86 in FIG. 5, upon closure of switch 88 and application of battery power through latch 54 to bus 60, motor 84 is energized by battery power. Pump 82 draws fuel from supply 34 through reservoir 36 of carburetor 32, with air trapped within reservoir 36 thus being purged from the carburetor reservoir and entrained in fuel received at pump 82. Such air and fuel mixture is fed by pump 82 to nozzle 42. When pump 82 pumps fuel to nozzle 42, nozzle back pressure loads pump 82 and therefore causes motor 84 to load battery 52. On the other hand, when air is ejected from the fuel line at nozzle 42, the load on pump 82 and the drive current to motor 84 are correspondingly reduced. Thus, time intervals during which fuel is supplied to carburetor air inlet 44 can be distinguished from time intervals during which air is purged from the fuel system by monitoring the load applied by motor 84 to the battery power supply. Referring to FIG. 7, battery voltage Vcc is thus, in effect, loaded during the time intervals 106, 108, 110 during which fuel is actually delivered to nozzle 42, but is at a relatively high or unloaded state during the intervals 112, 114, 116 when air is purged through nozzle 42. Comparator 92 (FIG. 5) senses such battery load and provides the output illustrated in FIG. 7 to effectively inhibit operation of integrator 94 during periods 112, 114, 116 in which air is purged, and to permit integrator operation during periods 106, 108, 110 in which fuel is delivered at nozzle 42. Integrator 94 thus exhibits a stepped ramp voltage output as illustrated in FIG. 7 which increases during periods 106, 108, 110 when fuel is delivered, but remains flat or constant during periods 112, 114, 116 when air is purged.

When the output of integrator 94 reaches the reference level supplied by temperature compensator 100 at time t1 in FIG. 7, the priming operation is terminated by comparator 102. Such reference level is determined not only as a function of engine temperature at sensor 50, but also as a function of battery voltage at compensator 96 as a reference to temperature amplifier 100. Thus, as battery 52 ages and available battery power declines, the reference signal to temperature compensator 100 and comparator 102 is adjusted accordingly, such that the quantity o fuel injected at the carburetor inlet depends solely upon engine temperature and is substantially independent of both quantity of air purged from the carburetor and declining battery power. As in the embodiment of FIGS. 1-3, power latch 54 and timer 56 prevent repriming in the event of first-pull failure.

Figure 6:
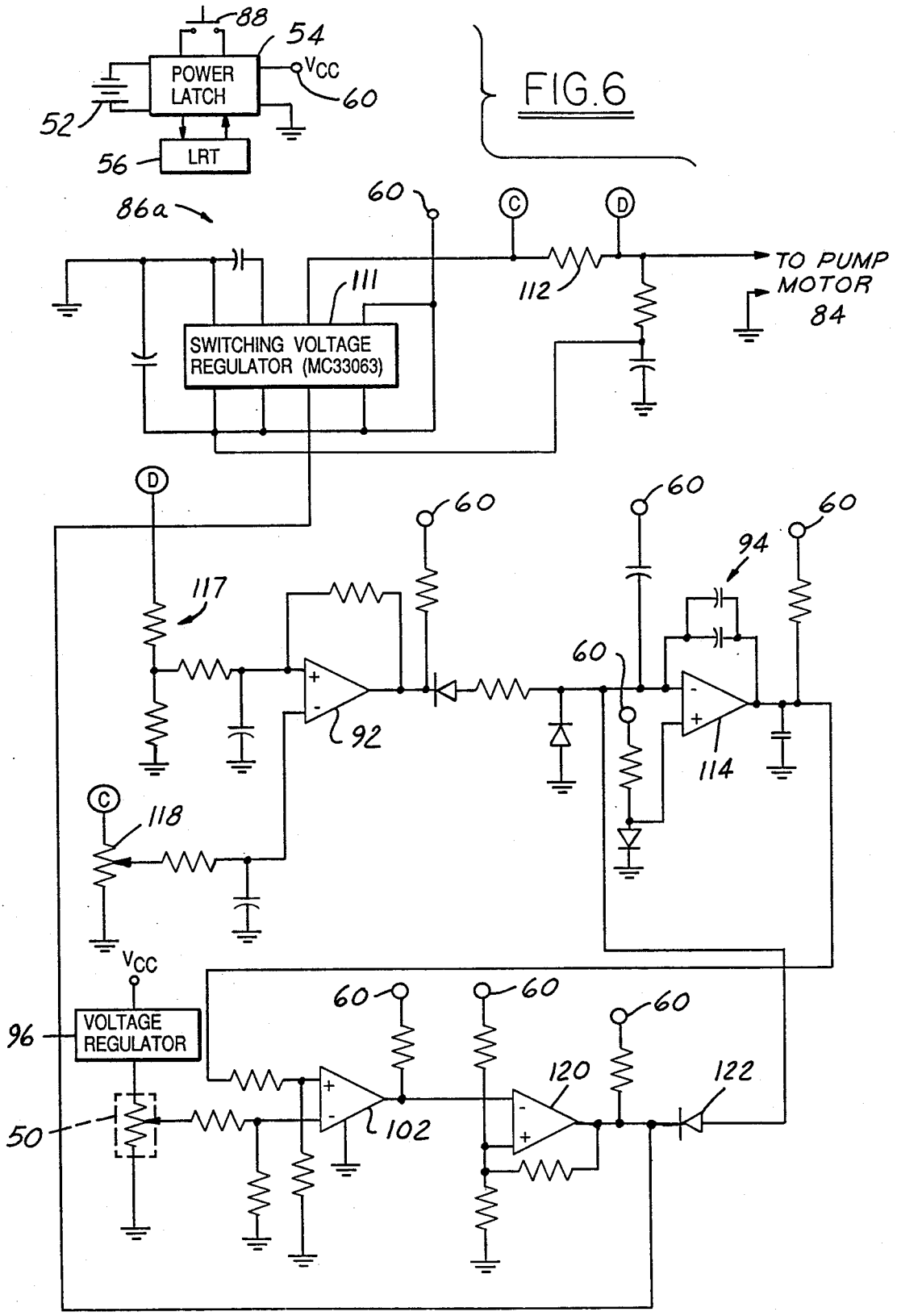
FIG. 6 is an electrical schematic diagram of another embodiment of priming control electronics in the system of FIG. 4.

FIG. 6 illustrates modified priming control electronics 86a for use in the system of FIG. 4. Pushbutton 88 and battery 52 are connected to latch 54, timer 56 and bus 60 as previously described. Power bus 60 is connected to a switching voltage regulator 111 which supplies switched power to motor 84 through a current sensing resistor 112. The duty cycle of switched power to motor 84, and thus average applied voltage, depends upon the programming inputs to regulator 111, and preferably is fixed by circuit design as a function of motor 84. Comparator 92 has respective inputs connected across resistor 112, the non-inverting input being connected to terminal D on the "negative" side of resistor 112 through the voltage divider 117, and the inverting input of comparator 92 being connected to terminal C on the "positive" side of resistor 112 through the variable resistor 118. Resistor 118 is factory adjusted as a function of back-pressure characteristics of nozzle 42 and load characteristics of pump 82 and motor 84. The output of comparator 92 thus assumes the waveform illustrated in FIG. 7, being a high or positive one when current through resistor 112 indicates minimal motor load on the battery, and at a low or zero level when current through resistor 112 indicates substantial motor load, corresponding to time intervals 106, 108, 110 in which fuel is supplied to the carburetor air intake as previously described.

The output of comparator 92 feeds integrator 94, which integrates when the input thereto is low, and thus supplies the stepped ramp signal illustrated in FIG. 7 to the non-inverting input of comparator 102. The inverting input of comparator 102 receives a reference signal from temperature sensor 50, which is powered through a temperature-compensated voltage regulator 96. The output of comparator 102, which is initially low and goes high when the input voltage level from integrator 94 exceeds the temperature-reference level from sensor 50, is fed to an inverter 120. The output of inverter 120 is connected through the isolation diode 122 to the signal input of integrator 94, and is also connected to the on/off control input of regulator 111. Thus, regulator 111 is turned on and supplies switched power to motor 84 until the output of integrator 94 exceeds the reference level of sensor 50. At that time, not only is regulator 110 switched off by inverter 120, but integrator 94 is also saturated through diode 122.

It will thus be appreciated that the several embodiments of the invention hereinabove described fully satisfy all of the objects and aims previously set forth. Although provision of latch 54 and timer 56 in each embodiment is preferred, the same may be deleted from the priming control electronics without departing from the remaining principles of the invention. If latch 54 and timer 56 were deleted in the embodiment of FIG. 6, for example, the operator would be given the option of repriming at will, and would hold switch 88 closed as long as motor 84 is engaged by the priming control signal.

The invention claimed is:

1. A system for priming an internal combustion engine which includes a carburetor having a fuel reservoir, said system comprising:

pump means having an inlet, first and second outlets, means responsive to an electrical priming control signal for feeding fuel under pressure to said first outlet, and means for feeding air entrained in fuel within said pump means to said second outlet, means for feeding fuel from a fuel supply through said carburetor reservoir to said inlet of said pump means, means coupled to said first outlet of said pump means for feeding fuel under pressure from said pump means to said carburetor, means coupled to said second outlet of said pump means for purging air from within said pump means, and electronic control means including means for initiating a priming operation and means responsive to said operation-initiating means for supplying said priming control signal to said pump means.

2. The system set forth in claim 1 wherein said pump means includes means forming an internal reservoir for storing a predetermined volume of fuel under pressure, and electrical valve means responsive to said priming control signal for selectively coupling said pump reservoir to said first and second outlets.

3. The system set forth in claim 2 further comprising means coupling said second outlet to said fuel supply.

4. The system set forth in claim 3 wherein said means coupling said second outlet to said fuel supply comprises means for restricting flow therethrough.

5. The system set forth in claim 4 wherein said pump means comprises a manual pump having said internal reservoir, a resilient bulb and check valve means responsive to said bulb for alternately drawing fuel from said supply through said carburetor reservoir into said pump reservoir and supplying fuel under pressure from said pump reservoir to said electrical valve means.

6. The system set forth in claim 5 wherein said operationinitiating means comprises means coupled to said pump means and responsive to said predetermined fuel volume within said pump reservoir for initiating said priming operation.

7. The system set forth in claim 6 wherein means forming said pump reservoir comprises an expansible volume, and wherein said operation-initiating means comprises switch means responsive to said expansible volume.

8. The system set forth in claim 5 wherein said electrical valve means comprises a solenoid valve normally connecting said pump reservoir to said second outlet and responsive to said priming control signal for connecting said pump reservoir to said first outlet.

9. The system set forth in claim 8 wherein said electronic control means further includes temperature sensor means coupled to said engine and responsive to temperature thereof, and means responsive to said temperature sensor means and to said operation-initiating means for supplying said priming control signal for a time duration that varies as a function of engine temperature.

10. The system set forth in claim 9 wherein said electronic control means includes battery means for supplying electrical power, and means responsive to battery voltage for compensating said signal-supplying means to supply said priming control signal for said time duration independently of fluctuation in battery voltage.

11. The system set forth in claim 9 wherein said electronic control means further comprises means responsive to said operation-initiating means for preventing resupply of said priming control signal for a preselected time duration independently of said operation-initiating means.

12. The system set forth in claim 11 wherein said resupplypreventing means is constructed to prevent resupply of said priming control signal for a preselected fixed time duration that is independent of engine temperature.

13. The system set forth in claim 1 wherein said electronic control means further includes temperature sensor means coupled to said engine and responsive to temperature thereof, and means responsive to said temperature sensor means and to said operation-initiating means for supplying said priming control signal for a time duration that varies as a function of engine temperature.

14. The system set forth in claim 13 wherein said electronic control means includes battery means for supplying electrical power, and means responsive to battery voltage for compensating said signal-supplying means to supply said priming control signal for said time duration independently of fluctuation in battery voltage.

15. The system set forth in claim 13 wherein said electronic control means further comprises means responsive to said operation-initiating means for preventing resupply of said priming control signal for a preselected time duration independently of said operation-initiating means.

16. The system set forth in claim 15 wherein said resupply-preventing means is constructed to prevent resupply of said priming control signal for a preselected fixed time duration that is independent of engine temperature.

* * * * *